United States Patent [19]

Holcombe

[11] 4,151,692

[45] May 1, 1979

[54] T-SHAPED INSULATION WITH VAPOR BARRIER

[75] Inventor: J. L. Holcombe, Dallas, Tex.

[73] Assignee: Emerson H. Mizell, Atlanta, Ga.

[21] Appl. No.: 816,251

[22] Filed: Jul. 15, 1977

[51] Int. Cl.[2] ..... E04B 1/74

[52] U.S. Cl. ..... 52/404; 52/309.8; 52/309.13; 52/811

[58] Field of Search ..... 52/404, 406, 407, 622, 52/309.8, 309.13, 105; 428/161, 192, 121

[56] References Cited

U.S. PATENT DOCUMENTS

| | | | |
|---|---|---|---|
| 2,998,337 | 8/1961 | Tillotson | 52/406 |
| 3,298,150 | 1/1967 | Ahlquist | 52/406 X |
| 3,343,314 | 9/1967 | Smith | 52/406 X |
| 3,729,879 | 5/1973 | Franklin | 52/406 X |
| 3,835,604 | 9/1974 | Hoffmann, Jr. | 52/105 |
| 3,913,292 | 10/1975 | Braekkan | 52/406 |
| 3,921,355 | 11/1975 | Pennecot | 52/284 X |
| 3,969,863 | 7/1976 | Alderman | 52/407 |
| 4,010,300 | 3/1977 | Wallin | 428/121 |

FOREIGN PATENT DOCUMENTS

| | | | |
|---|---|---|---|
| 2315793 | 10/1974 | Fed. Rep. of Germany | 52/407 |
| 2320507 | 11/1974 | Fed. Rep. of Germany | 52/404 |
| 2329372 | 1/1975 | Fed. Rep. of Germany | 52/406 |
| 2340309 | 2/1975 | Fed. Rep. of Germany | 52/406 |
| 1303644 | 8/1961 | France | 52/622 |
| 2273223 | 12/1975 | France | 52/406 |

*Primary Examiner*—Leslie Braun

*Attorney, Agent, or Firm*—Shlesinger, Arkwright, Garvey & Dinsmore

[57] ABSTRACT

A T-shaped batt of insulation with a U-shaped vapor barrier covering the lower surface of the batt. The vapor barrier, which extends beyond the ends of the batt is used to connect consecutive batts. The T-shaped batts are installed by rolling them between parallel structural members so that the horizontal flange sections of the T-shaped batts overlap atop the structural members.

4 Claims, 5 Drawing Figures

T-SHAPED INSULATION WITH VAPOR BARRIER

FIELD OF INVENTION AND BACKGROUND

This invention relates to strip insulation adapted for quick installation. The insulation is T-shaped to fit between parallel support members.

The prior art includes a number of patents which disclose batts of insulation adapted for implacement on or between parallel support members. U.S. Pat. No. 3,488,905 to Campbell, for example, discloses a one piece batt of insulation with thin lateral flanges which do not support the batt. However, the insulation is secured to corrugated sheets which rest on parallel joists.

U.S. Pat. No. 3,474,583 to Manias discloses the use of two apparently identical pieces of insulation which are laid on top of each other but slightly offset so as to form a notch on each side of the batt.

A number of patents show batts of insulation with facing sheets which rest on parallel support members. Hoffmann U.S. Pat. No. 3,835,604 discloses a solid piece of insulation with a facing sheet on one surface. The facing sheets of parallel adjacent batts are secured to joists in an overlapping fashion. Similarly the U.S. Pat. No. 3,729,879 to Franklin shows a batt of insulation in which the facing material forms lateral flanges which are placed on parallel joists. Waterman U.S. Pat. No. 2,271,575 discloses a similar batt and Bennett in U.S. Pat. No. 3,231,944 discloses a similar batt which is merely placed in the void formed by parallel joists. *German Pat. No. 2,320,507 discloses a rectangular plate of insulation which is held in a rectangular box of facing material having lateral flanges. The facing flanges overlap on parallel joists.

*Offenlegungsschrift

U.S. Pat. No. 1,874,659 to Upson shows a batt which has longitudinal edge portions which are relatively thin or compressed.

FEATURES AND SUMMARY

The features of this invention result in a batt of insulation which is both inexpensive and simple to install. The batt can be installed simply by unrolling the insulation on top of a support structure and can be secured by attaching a covering panel. Thus the invention is particularly adapted for but not limited to use in roofs of prefabricated metal buildings. The T-shaped batt can be constructed inexpensively in a one or two piece form. Moreover, if a roll of insultion should run out before the void between the parallel structural members is filled means are provided for joining consecutive batts of insulation while maintaining a water impervious barrier.

This invention relates to a T-shaped batt of insulation with a U-shaped vapor barrier covering the lower surface of the batt. The vapor barrier extends beyond the longitudinal ends of the batt. Consecutive batts are connected by folding adjacent vapor barrier extensions upwardly, and connecting these extensions in any suitable manner. The T-shaped batts are formed either by notching out the edges of the batt using a high speed saw or by attaching a wider piece of insulation on top of a narrower one. The batts of insulaton fit substantially between parallel support members; however, the narrow horizontal flanges of adjacent T-shaped batts overlap on top of the support members and are retained by a covering panel.

DESCRIPTION OF THE INVENTION

Figure 1:
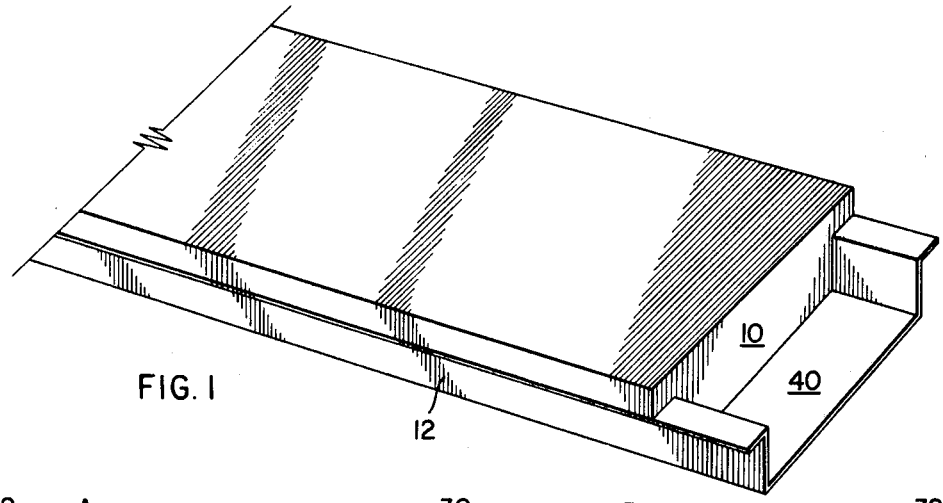
FIG. 1 shows a perspective view of one end of a batt of insulation and the extension of the vapor barrier beyond the end of the batt.
Figure 2:
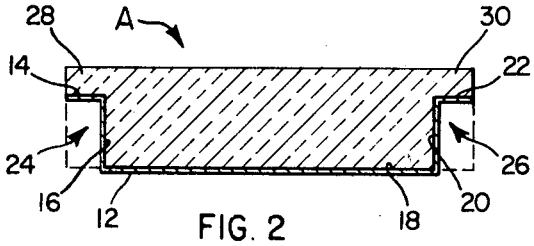
FIGS. 2 and 3 show cross-sectional views of a one and a two piece batt of insulation respectively.

A T-shaped batt of insulation is shown in FIG. 1. The batt consists of a T-shaped batt of insulating material 10 and a U-shaped vapor barrier 12. As shown in FIG. 2 the vapor barrier 12 contacts only the lower surfaces 14, 16, 18, 20 and 22 of the T-shaped batt A.

The vapor barrier 12 may be sheet vinyl, foil-reinforced kraft, vinyl-reinforced foil, vinyl-reinforced polyester or any other material substantially impervious to water vapor. The barrier 12 is applied to the insulation 10 with a suitable adhesive using conventional lamination equipment.

Figure 3:
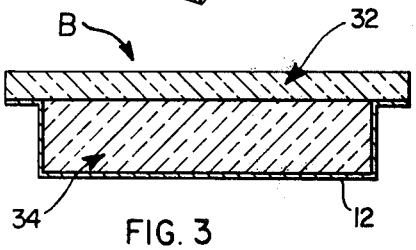

The batt 10 can be made in either one or two pieces as shown in FIGS. 2 and 3. The solid batt 10 is shown in FIG. 2. It is made by notching out the lower corners of a rectangular batt indicated in dashed lines to form notch 24 consisting of walls 14 and 16, notch 26 consisting of walls 20 and 22, and also to form flanges 28 and 30. The cutting can be done with a high speed saw. The size of the notches 24 and 26 and their geometry is totally at the discretion of the user. FIG. 2 shows the preferred form in which the vertical height of the notches 24 and 26 is substantially greater than the height of the flange sections 28 and 30. More specifically in the preferred form the notch height is from two to four times the height of the flange. The flange could have a height of approximately two inches.

The two piece batt B shown in FIG. 3 is made by connecting two strips of insulation 32 and 34. The top strip 32 which is wider than the base strip 34 is attached in any suitable manner and preferably is glued to the base strip.

Figure 4:
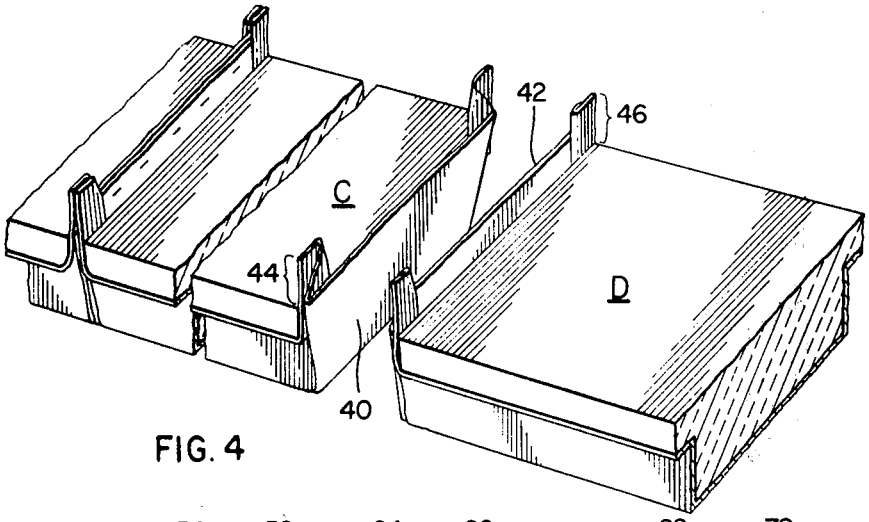
FIG. 4 shows how two strips of insulation can be connected in an end-to-end fashion.

Consecutive batts are connected together in the manner indicated in FIG. 4. As shown in FIG. 1, each batt's vapor barrier 12 extends beyond each longitudinal end of the batt 10. The vapor barrier extension sections 40 and 42 are folded upwardly flush against the end of its batt C or D. The extension 40 shown in FIG. 1 should be long enough to provide a crest 44 or 46 above the upper surface of the batt which could be about two inches or about $\frac{1}{4}$ to $\frac{1}{2}$ of the height of the batt. Thus the length of the extension 40 may be from $1\frac{1}{4}$ to $1\frac{1}{2}$ times the height of the batt 10. The adjacent upstanding vapor barrier extension sections 40 and 42 are then spliced together by folding and stapling the protruding crests 44 and 46 together, heat sealing them if a plastic vapor barrier is used, or by any other suitable means.

Figure 5:
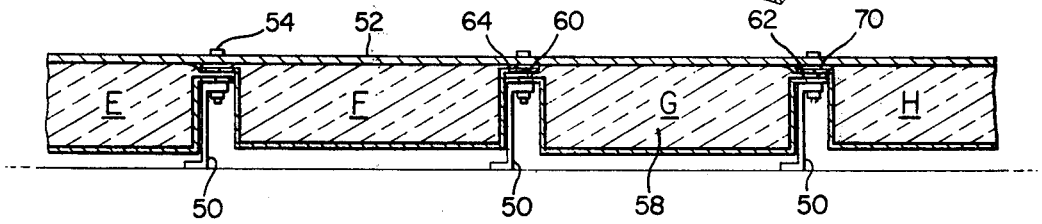
FIG. 5 shows a cross-sectional view of the T-shaped insulation installed in a roof structure.

One method of installing the insulation is illustrated in FIG. 5 which shows a roof structure having parallel Z-shaped purlins 50, roof panel 52, fasteners 54 and insulation batts E, F, G and H. The batts of insulation, supplied in rolls, are unrolled so that the vertical portion 58 of each batt fits into the void between the purlins 50 while the horizontal flange portions 60 and 62 rest atop the purlins. If a roll runs out before the entire length of the channel between the purlins is filled, a new batt can be spliced to the old as described above and illustrated in FIG. 4.

Adjacent parallel batts such as batts F and H adjacent to batt G are laid to insure that the horizontal flange portions 60 and 64, and 62 and 70 overlap. Thus each flange must have a width greater than half the width of the purlin 50. FIG. 5 shows an arrangement wherein every other batt such as batt E and G are laid first and intermediate batts such batts F and H are laid so as to overlap the first laid batts. However, other arrangements could be used including laying batts a row at a time so that one horizontal flange portion on each batt would be atop the adjacent batt and the other flange portion would be below the other adjacent batt.

The insulation shown in FIG. 5 is secured and compressed into the voids between purlins by laying roof panel 52 on top of the purlins and overlapping horizontal flange portions. The roof panel can then be secured to the purlins by fasteners 54. In this way the horizontal flange portions serve as a barrier to heat transfer by conduction between the roof panel and the purlins.

While this invention has been described as having a preferred design, it will be understood that it is capable of further modificaton. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. A generally rectangular shaped rollable and unrollable insulation unit comprising:

(a) a solid batt having a T-shaped cross section extending from one end to the other end of said batt including a T cross bar and a T cross bar support;

(b) said T cross bar and said T cross bar support each being continuous, uniform and solid in cross section section throughout their length;

(c) said T cross bar including side, upper, lower and end surfaces;

(d) said T cross bar support including side, end and lower surfaces;

(e) a U-shaped vapor barrier attached to said batt and covering said T cross bar lower surface only and said T cross bar support lower and side surfaces;

(f) said vapor barrier having an end portion extending beyond at least one end of said batt a distance from about $1\frac{1}{4}$ to $1\frac{1}{2}$ times the height of said batt;

(g) said vapor barrier end portion being folded upwardly against at least one end of said batt including said one end T cross bar and T cross bar support end surfaces and extending above said upper surface of said T cross bar; and (h) said T cross bar support being in vertical height greater than the height of said T cross bar by from about two to four times.

2. An unrollable insulation unit as in claim 1 and wherein:

(a) said vapor barrier includes a second end extending beyond said other end of said batt a distance from about $1\frac{1}{4}$ to $1\frac{1}{2}$ times the height of said batt; and (b) said second end of said vapor barrier is folded upwardly against said other end of said batt including said other end T cross bar and T cross bar support end surfaces, and extends above said upper surface of said T cross bar.

3. An unrollable insulation unit as in claim 1 and wherein:

(a) said batt T cross bar and T cross bar support are individually generally rectangular members bonded together.

4. A plurality of interconnected generally rectangular shaped rollable and unrollable insulating units comprising:

(a) at least two solid abutting batts each having a T-shaped cross section extending from one end to the other end of each batt including a T cross bar and a T cross bar support;

(b) each of said T cross bars and said T cross bar supports being continuous, uniform and solid in cross section throughout their length;

(c) each of said T cross bars including side, upper, lower and end surfaces;

(d) each of said T cross bar supports including side, end and lower surfaces;

(e) a U-shaped vapor barrier attached to each of said batts and each covering its respective T cross bar lower surface only and its respective T cross bar support lower and side surfaces;

(f) each of said vapor barriers having an end portion extending beyond at least one end of its respective batts a distance from about $1\frac{1}{4}$ to $1\frac{1}{2}$ times the height of its respective batt; and (g) each of said vapor barrier end portions being folded upwardly against at least one end of its respective batt including its respective one end T cross bar and T cross bar support surfaces, and each extending above its respective upper surface of its respective T cross bar;

(h) said upwardly folded end portions of said vapor barriers of said at least two abutting batts being in abutting relation and secured to each other; and (i) said cross bar support being in vertical height greater than the height of said T cross bar by from about two to four times.

* * * * *